United States Patent [19]

Duemmig-Zitzmann

[11] Patent Number: 4,747,274

[45] Date of Patent: May 31, 1988

[54] DEVICE FOR COOLING BEVERAGE CONTAINERS, PARTICULARLY BOTTLES

[75] Inventor: Joerg Duemmig-Zitzmann, Wertheim, Fed. Rep. of Germany

[73] Assignee: Alfi Zitzmann GmbH & Co, Wertheim, Fed. Rep. of Germany

[21] Appl. No.: 71,931

[22] Filed: Jul. 10, 1987

[30] Foreign Application Priority Data

Jul. 10, 1986 [DE] Fed. Rep. of Germany ... 8618514[U]

[51] Int. Cl.[4] ..... F25D 3/08

[52] U.S. Cl. ..... 62/371; 62/372; 62/457

[58] Field of Search ..... 62/430, 438, 457, 372, 62/371

[56] References Cited

U.S. PATENT DOCUMENTS

| | | | |
|---|---|---|---|
| 3,365,911 | 1/1968 | Stoner et al. | 62/457 |
| 4,344,300 | 8/1982 | Taylor | 62/457 |
| 4,344,301 | 8/1982 | Taylor | 62/457 |
| 4,438,637 | 3/1984 | Atkinson | 62/457 |
| 4,481,792 | 11/1984 | Groeger et al. | 62/457 |
| 4,531,381 | 7/1985 | Toro et al. | 62/372 |
| 4,544,022 | 10/1985 | Tomac | 62/372 X |
| 4,607,502 | 8/1986 | Tomac | 62/372 X |
| 4,704,875 | 11/1987 | Kieler | 62/372 |

*Primary Examiner*—Lloyd L. King

*Attorney, Agent, or Firm*—Sixbey, Friedman & Leedom

[57] ABSTRACT

A device for cooling beverage containers, particularly bottles, having a receiver unit with an inclined upper surface, and at least one cooling element that is removable from the receiver unit. A receiving chamber is located beneath the upper support surface with the cooling element being disposed beneath the upper support surface and, preferably, forming an upper boundary wall of the receiving chamber. Thus, intensive cooling can be provided to containers in the receiving chamber, while bottles deposited upon the upper support surface will only be slightly cooled or not cooled at all. The cooling element is preferably an essentially block- or plate-shaped hollow body that is filled with a cooling medium, the cooling element being cooled down in a refrigerator, freezer, or the like, prior to insertion into the receiving unit.

20 Claims, 4 Drawing Sheets

DEVICE FOR COOLING BEVERAGE CONTAINERS, PARTICULARLY BOTTLES

BACKGROUND AND SUMMARY OF THE INVENTION

The invention relates to a device for cooling beverage containers, particularly bottles, having a receiver unit with an inclined upper surface, and at least one cooling element that is removable from the receiver unit.

In a known device of this kind, U.S. Pat. No. 3,365,911, two cooling elements filled with a refrigerant are cooled in a refrigerator or freezer and then placed onto an upper support surface, whereupon a bottle to be cooled is placed between the two cooling elements, which together partly envelop the outer circumference of the bottle. This has the advantage of leaving the label of the bottle visible. On the other hand, this device has the disadvantage that it does not provide any means for temperature regulation.

Based upon the principle of the above-noted known device, it is the objective of the invention to create a portable cooling device which permits beverages to be maintained at selected different temperatures.

This objective is achieved in that the receiving unit is provided with a receiving chamber that is located beneath an upper support surface, which chamber is open in the front. In this manner, the user can selectively place beverage containers, for example, bottles, cans or the like, either onto the upper support surface, or the user may slide them into the receiving chamber, in order to provide different temperatures for the respective beverages based upon the combined effects of the refrigeration stored in the cooling element and the ambient temperature.

Preferably, the cooling element is inserted into the receiver unit between the upper support surface and receiving chamber, and, in this state, the cooling element forms at least a portion of the upper boundary wall of the receiving chamber. In such an instance, intensive cooling is provided to containers in the receiving chamber, while bottles deposited on the upper support surface will only be slightly cooled, or, beverages which are to be consumed at room temperature, e.g., mineral waters, will not be cooled at all.

Appropriately, the upper support surface and the lower boundary wall of the receiving chamber extend parallel or nearly parallel to each other. Advantageously, only a single cooling element is provided which essentially extends over the entire width of the receiver unit, a factor which simplifies the handling of the cooling device. Both the upper support surface and the receiving chamber, appropriately, can form supports for bracing of the two or more adjacent beverage containers independent of the cooling element. In this form, the cooling device is particularly suitable for use on conference tables, and similar surfaces. The changing of the cooling element can be effected easily without touching or removing the bottles, and further, very importantly, without causing noise (no clattering of the bottles), which fact is an important aspect for use at conferences or meetings while they are in progress.

The receiver unit may have a rear part and a front part, fixedly connected therewith, and between which parts a heat insulating material can be introduced, if desired. The front part may be formed with an aperture in what constitutes the front face of the receiver unit, and both the rear part and the front part can be cup-shaped, whereby the front part projects into the rear part. Appropriately, the receiver unit is also provided with at least one mounting element for a bottle opener.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
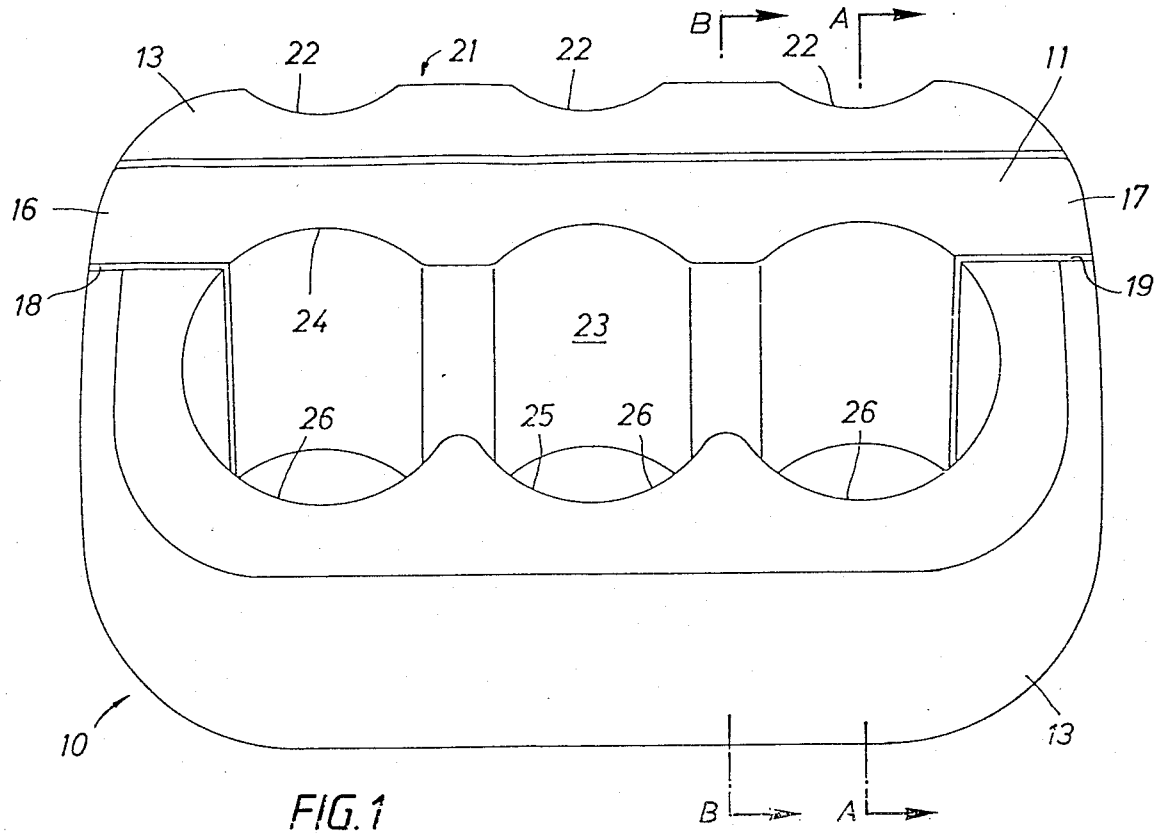
FIG. 1 is a front view of the cooling device.
Figure 2:
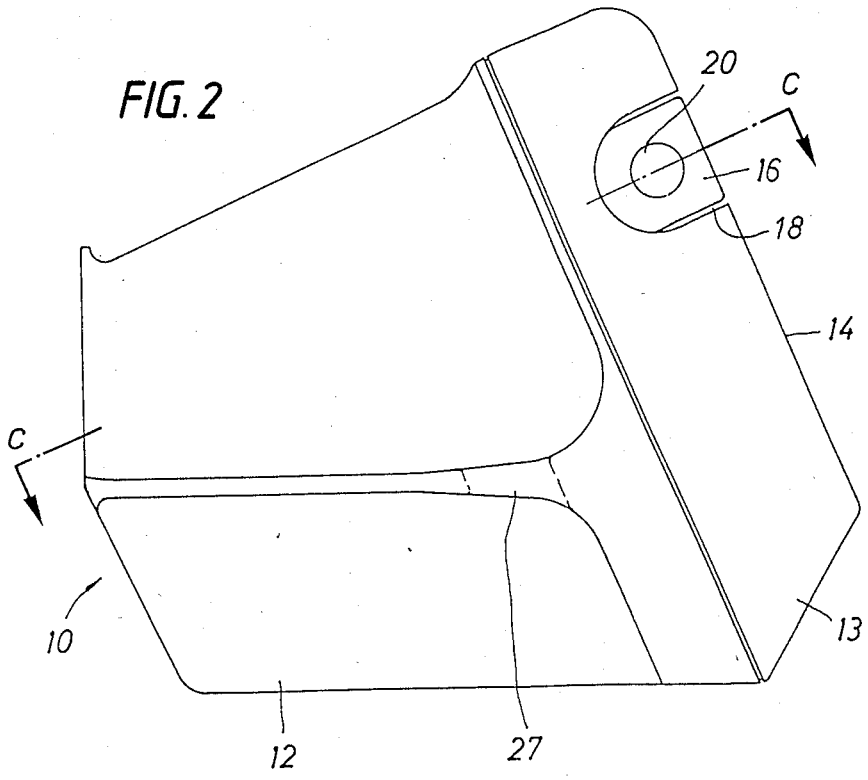
FIG. 2 is a side view of the cooling device in accordance with FIG. 1.
Figure 3:
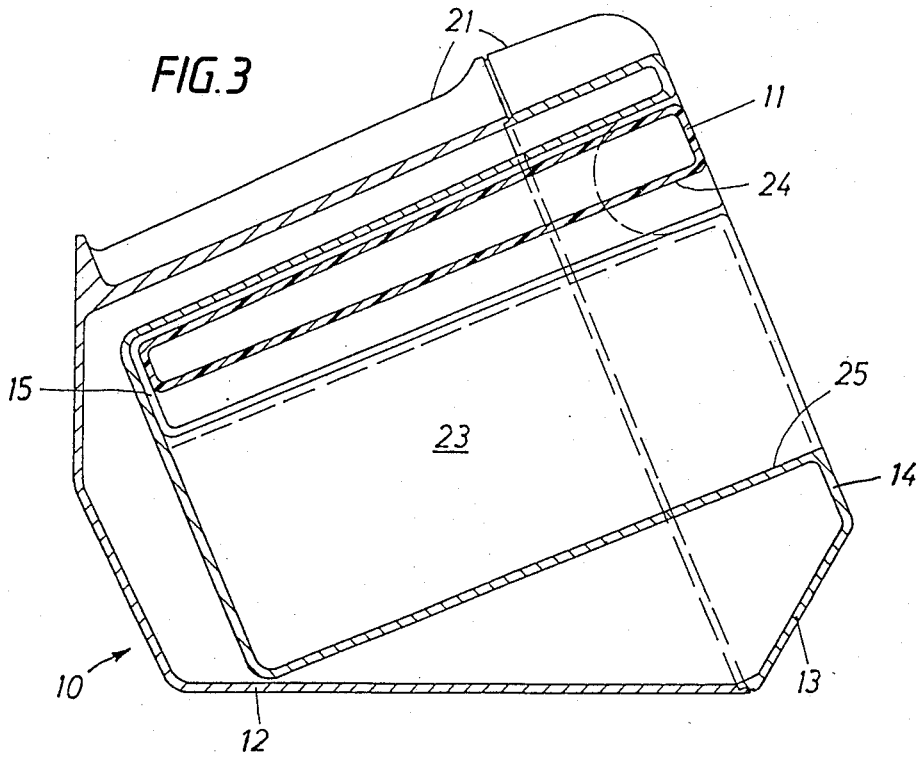
FIGS. 3 and 4 are sectional views along lines A—A and B—B, respectively, of FIG. 1.
Figure 4:
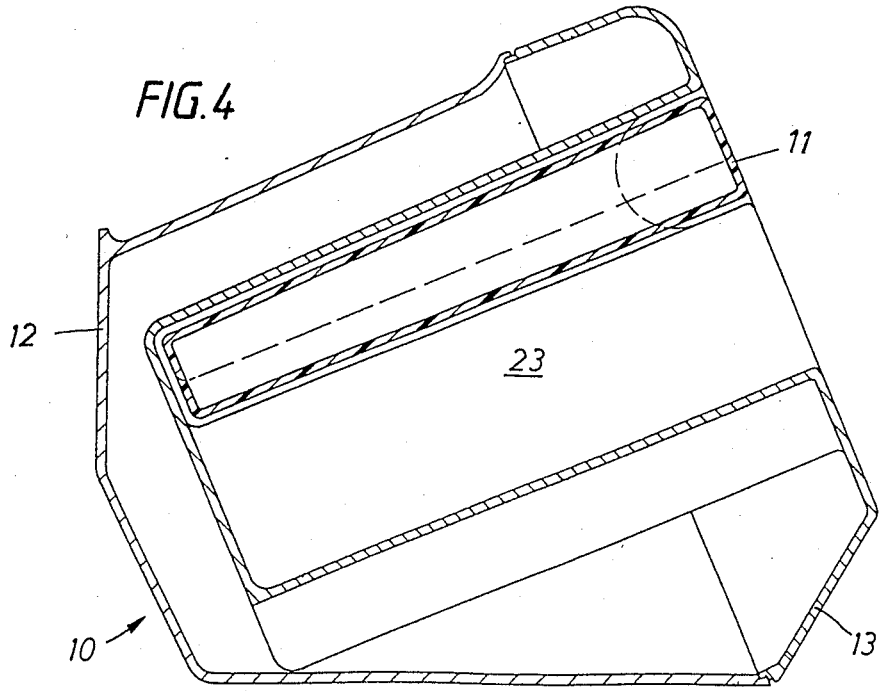
Figure 5:
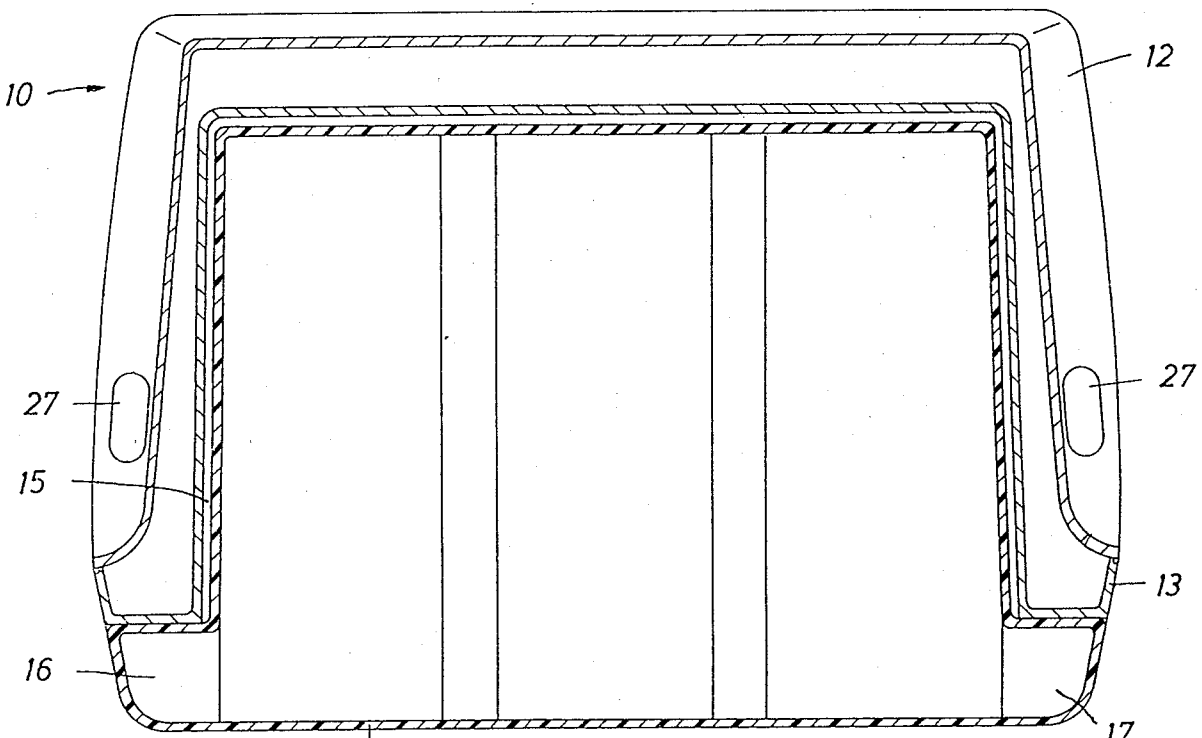
FIG. 5 is a sectional view along line C—C of FIG. 2.

The cooling device depicted has a receiver unit 10 and a cooling element 11. Receiver unit 10 consists of a rear part 12 and a front part 13 that is fixedly connected therewith. Rear part 12 and front part 13 have cup-like shapes, whereby the front part projects into the rear part, as can be seen from FIGS. 3, 4 and 5. The front part 13 is provided with an aperture and forms the front surface 14 of the receiver unit 10. Furthermore, front part 13 has a recess 15 into which cooling element 11 is inserted. Cooling element 11 is essentially block- or plate-shaped and is filled with a cooling medium, such as a nontoxic freezable liquid or gelatin refrigerant of a type conventionally used in freezer packs for maintaining foods cold after having been cooled down in a refrigerator, freezer, or the like. For example, a mixture containing water and glycerine may be used as the cooling medium. Cooling element 11 has shoulders 16, 17 at both sides which are received in complementarily shaped portions 18, 19 of recess 15 and extend laterally to the outer surface of receiver unit 10. Indentations 20 are provided at both sides of the cooling element 11, in the end surface of each of the shoulders 16, 17 (FIG. 2), which facilitate a withdrawal of cooling element 11 from receiver unit 10.

The receiver unit 10 has an upper support surface 21 which is inclined downwardly in a direction rearwardly away from front surface 14, and has three supports 22 extending parallel to each other in a common plane, for accommodating three beverage containers, bottles in particular. Beneath the upper support surface 21, there is a receiving chamber 23 which is open at the front surface 14 and whose upper boundary wall 24 is formed by the underside of cooling element 11 when it has been inserted into receiver unit 10. The remaining boundary walls of the receiving chamber 23 are formed by the front part 13. The lower boundary wall 25 of receiving chamber 23 is parallel to the upper support surface 21 and receiver chamber 23 is provided with supports 26 for three beverage containers, particularly bottles, which supports extend parallel to each other.

At both sides of receiver unit 10, the upper part 13 has a respective opening 27 into which a bottle opener may be inserted. At the bottom part of rear part 12, there are appropriate elements (not depicted) for enhancing the skid resistance; for instance, in the form of small rubber feet. Rear and front parts 12, 13 may be made of a metal or synthetic plastic material. In the latter case, both parts, preferably, are ultrasonically welded together.

When using the illustrated cooling device on a conference table, for instance, the previously refrigerated cooling element 11 is inserted into recess 15 in the manner depicted in the drawings. The receiver chamber 23 accommodates insertion of three bottles, or similar items, side-by-side, for intensive cooling there. Three additional bottles containing beverages not requiring the intensive cooling provided by receiving chamber 23, or which are merely being held in reserve, can be placed onto the upper support area 21.

While I have shown and described an embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Device for cooling of beverage containers, particularly bottles, comprising a receiver unit having top and bottom sides between which extend front and rear ends, and an internal receiving chamber; wherein said top side of the receiver unit is provided with an inclined upper, exterior container support surface, wherein access to said internal receiving chamber is provided by an opening in said front end of the receiver unit, and wherein at least one cooling element is removably held by the receiver unit in a manner enabling said cooling element to serve as a means for cooling beverage containers disposed on said upper support surface and within said receiving chamber to different temperatures.

2. Device according to claim 1, wherein the cooling element is held by the receiver unit between the upper support surface and receiving chamber.

3. Device according to claim 2, wherein the cooling element, when held by the receiver unit, forms at least a portion of an upper boundary wall of the receiving chamber.

4. Device according to claim 3, wherein the upper support surface and a lower boundary wall of the receiving chamber are disposed substantially parallel to each other.

5. Device according to claim 4, wherein a single cooling element is provided which essentially spans over the entire width of receiver unit.

6. Device according to claim 5, wherein both the upper support surface and receiver chamber have supports for bracing at least two beverage containers.

7. Device according to claim 1, wherein the upper support surface and a lower boundary wall of the receiving chamber are disposed substantially parallel to each other.

8. Device according to claim 7, wherein a single cooling element is provided which essentially spans over the entire width of receiver unit.

9. Device according to claim 8, wherein both the upper support surface and receiver chamber have supports for bracing at least two beverage containers.

10. Device according to claim 7, wherein both the upper support surface and receiver chamber have supports for bracing at least two beverage containers.

11. Device according to claim 1, wherein the receiving unit is formed of a front part and a rear part that are fixedly connected together.

12. Device according to claim 11, wherein the front part defines an apertured face surface of receiver unit containing said opening.

13. Device according to claim 12, wherein the front part and the rear part both have a cup-like shape, and wherein the front part projects into the rear part.

14. Device according to claim 6, wherein the receiving unit is formed of a front part and a rear part that are fixedly connected together.

15. Device according to claim 14, wherein the front part defines an apertured face surface of receiver unit containing said opening.

16. Device according to claim 15, wherein the front part and the rear part both have a cup-like shape, and wherein the front part projects into the rear part.

17. Device according to claim 16, characterized in that receiver unit is provided with a minimum of one mounting device for a bottle opener.

18. Device according to claim 1, characterized in that receiver unit is provided with a minimum of one mounting device for a bottle opener.

19. Device according to claim 3, wherein the cooling element is comprised of a hollow body that is filled with a freezable cooling medium.

20. Device according to claim 3, wherein said cooling element is slidable into and out of said receiver unit and wherein the cooling element is provided with shoulders at each of opposite sides thereof which are received in complementarily shaped portions of the receiver unit.

* * * * *